US006798323B2

(12) United States Patent
Smith et al.

(10) Patent No.: US 6,798,323 B2
(45) Date of Patent: Sep. 28, 2004

(54) WELDED AC ELECTROMAGNET LAMINATION ASSEMBLY INCORPORATING SHADING COIL

(75) Inventors: Richard G. Smith, North Aurora, IL (US); William F. Ramm, Carol Stream, IL (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 19 days.

(21) Appl. No.: 09/957,140

(22) Filed: Sep. 20, 2001

(65) Prior Publication Data

US 2003/0052761 A1 Mar. 20, 2003

(51) Int. Cl.[7] ..... H01H 67/02
(52) U.S. Cl. ..... 335/132; 335/236
(58) Field of Search ..... 335/132, 236

(56) References Cited

U.S. PATENT DOCUMENTS

| | | | | | |
|---|---|---|---|---|---|
| 4,030,056 | A | * | 6/1977 | Patz | 335/245 |
| 4,899,121 | A | * | 2/1990 | Boothroyd | 335/245 |
| 5,578,979 | A | * | 11/1996 | Adams et al. | 335/245 |
| 2001/0030307 | A1 | * | 10/2001 | Bergstrom et al. | 251/129.15 |
| 2002/0008603 | A1 | * | 1/2002 | Seale et al. | 335/266 |

* cited by examiner

*Primary Examiner*—Lincoln Donovan
*Assistant Examiner*—Bernard Rojas

(57) ABSTRACT

An electromagnetically actuable device has a magnetic core proximate an armature and a coil selectively energized to draw the armature to the magnetic core. The armature and magnetic core are of laminated magnetic steel and have mating surfaces. At least one of the armature and magnetic core includes conductive weld or braze lines for integrally securing laminations together to define a conductive path proximate the mating surface to provide a shading coil.

14 Claims, 3 Drawing Sheets

WELDED AC ELECTROMAGNET LAMINATION ASSEMBLY INCORPORATING SHADING COIL

TECHNICAL FIELD OF THE INVENTION

This invention relates to electromagnetically actuable devices and, more particularly, to an electromagnet incorporating a shading coil.

BACKGROUND OF THE INVENTION

A typical electromagnetically actuable device has a magnetic core proximate an armature. A coil is selectively energized to draw the armature to the magnetic core. The device may be a solenoid, a contactor, a motor starter, or the like. The armature is operatively associated with a movable device such as movable contacts or an actuator. In many instances the coil is selectively energized from an AC power source. With AC-operated electromagnets, elimination or control of noise is a prime concern. To minimize noise the surface interface of the magnetic core and armature of each device must be matched to provide minimal magnetic "air gap" and a stable interface surface. The minimal air gap assures sufficient force to prevent movement and the stable surface interface prevents movements due to the widely changing forces in the AC-operated device. Particularly, a spring provides a constant force between the magnetic core and the armature. Energization of the coil counteracts the spring force to draw the armature toward the magnetic core. However, with an AC power source operating at, for example, 60 Hz, there are 120 zero crossings each second during energization. At each zero crossing the spring force may overcome the magnetic force causing the armature to be pushed away and then drawn back again. This can produce a noisy electromagnet.

Conventional shading coils have been used without success to address this problem. A conventional shading coil drives the formation of a small shaded magnetic pole formed on the interface or mating surface of the core or armature. The conventional shading coil is typically a conductive alloy in a stamped ring that is attached to the laminations of the AC electromagnet. These conventional coils routinely break and therefore are costly to produce and assemble. Also, the laminations of conventional coils are often held together with rivets that add costs to producing the electromagnets. The rivets provide points of failure. Accordingly, the inherent weakness of the rivets and the conventional shading coils typically limit the mechanical life of the electromagnet.

SUMMARY OF THE INVENTION

In accordance with the invention, a shading coil is formed in an electromagnet by welding or brazing or the like.

Broadly, there is disclosed herein an electromagnetically actuable device having a magnetic core proximate an armature and a coil selectively energized to draw the armature to the magnetic core. The device comprises the armature and magnetic core being of laminated magnetic steel and having mating surfaces. At least one of the armature and magnetic core includes means for integrally securing laminations together to define a conductive path proximate the mating surface to provide a shading coil.

It is a feature of the invention that the securing means comprises weld connections between adjacent laminations of the at least one of the armature and magnetic core.

It is another feature of the invention that the securing means comprises braze connections between adjacent laminations of the at least one of the armature and magnetic core. The braze connections may use a conductive alloy such as copper.

It is still another feature of the invention that the securing means comprises the sole means for securing the laminations together.

It is a further feature of the invention that a single conductive line is provided on the mating surface transverse to the laminations and a plurality of conductive lines are provided below the mating surface transverse to the laminations. It is a further feature of the invention that the single conductive line is of greater depth than the plurality of conductive lines.

There is disclosed in accordance with another aspect of the invention an electromagnetically actuable device having a magnetic core proximate an armature and a coil selectively energized to draw the armature to the magnetic core. The device comprises the armature and magnetic core including laminations of magnetic steel and having mating surfaces and at least one of the armature and one of the magnetic core including conductive areas formed integrally with the laminations to define a conductive path proximate the mating surface to provide a shading coil.

There is disclosed in accordance with still another aspect of the invention the method of forming an electromagnet having a magnetic core and an armature. The method comprises providing an armature and magnetic core formed of lamination of magnetic steel and having a mating surface and integrally securing the laminations together to define a conductive path proximate the mating surface to provide a shading coil.

Further features and advantages of the invention will be readily apparent from the specification and from the drawings.

DETAILED DESCRIPTION OF PREFERRED EMBODIMENTS

Figure 1:
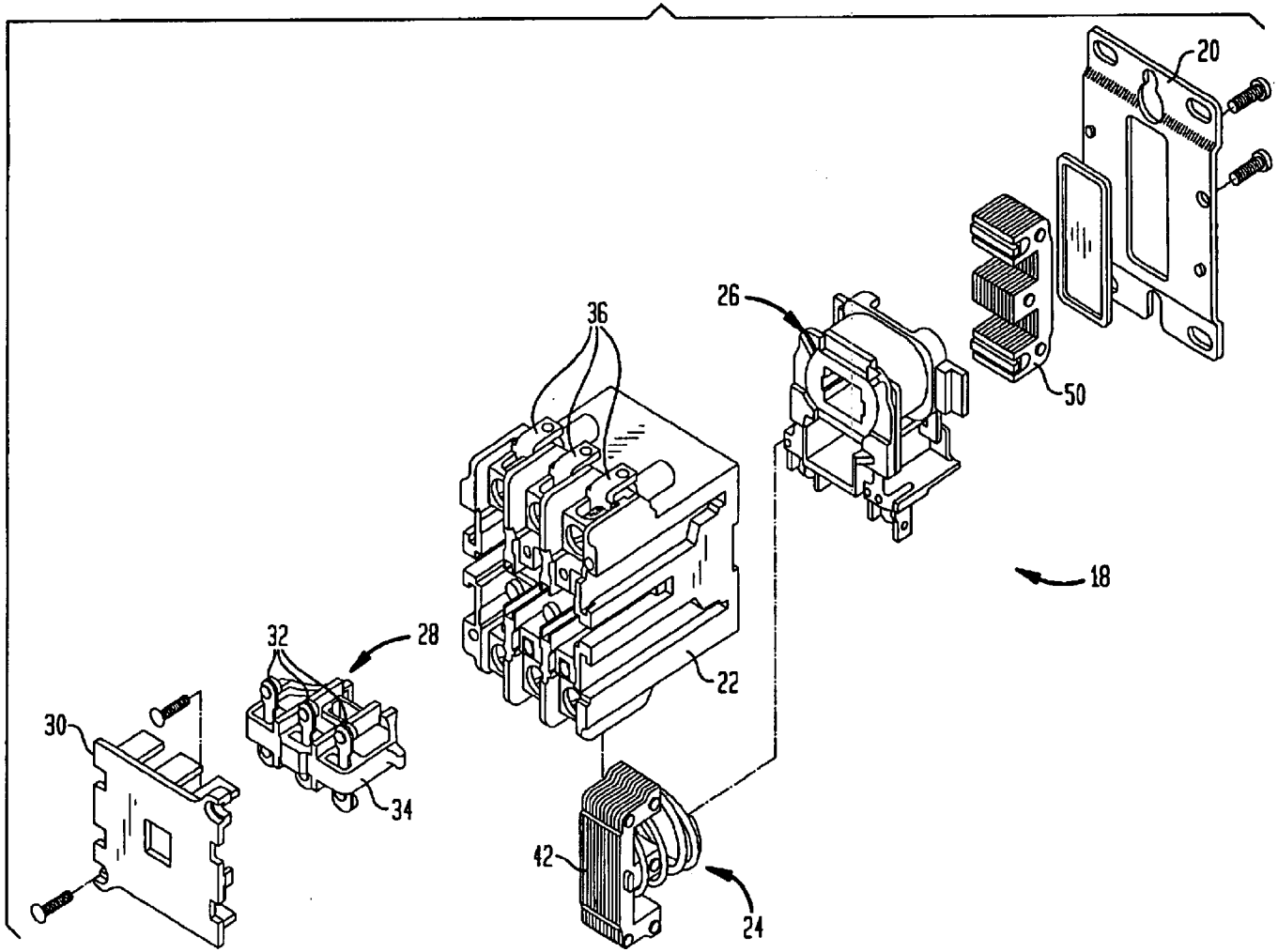
FIG. 1 is an exploded, perspective view of an electromagnetically actuable device in the form of a contactor including an electromagnet in accordance with the invention.

Referring initially to FIG. 1, an electromagnetically actuable device in the form of an electrical contactor 18 is illustrated in exploded form. The contactor 18 includes a base 20, a housing 22, an electromagnet 24, a coil 26 an actuator assembly 28 and a cover plate 30. The electromagnet 24 includes an armature 48 and a magnetic core 50. The housing 22 is mounted to the base 20 and encloses the coil 26 and the magnetic core 50. The magnetic core 50 is fixedly mounted in the housing 22. The magnetic core 50 is made of laminated magnetic steel, as is well known. The coil 26 includes a conventional bobbin, winding and terminal assembly and is located within the housing 22 and on the magnetic core 40. The armature 48 is also of laminated magnetic steel and is associated with movable contacts 32 carried on a contact carrier 34 moveable mounted in the housing 22. Particularly, the contact carrier 34 moves with the armature 48. The housing 22 also supports stationary contacts 36 positioned in proximity with the moveable contacts 32.

When the coil 26 is energized, the movable armature 48 is drawn toward the magnetic core 50 in a conventional manner. The movement of the armature 48 toward the magnetic core 50 causes the moveable contacts 32 to selectively open or close an electrical circuit with the stationary contacts 36, as is known.

While this application illustrates an electromagnetically actuable device in the form of a contactor, the teachings of the invention can similarly be applied to other electromagnetically actuable devices such as AC solenoids, electromagnetic actuators, motor starters, or the like.

In accordance with the invention, the electromagnet 24 uses weld penetration areas as conductive sections to replace conventional shading coils and structurally hold the laminations together as an assembly. Conductive alloys may optionally be added to the weld or braze areas to improve the conductivity of the resulting shading coil zone, as the resistivity of the lamination material is not extremely low.

Figure 2:
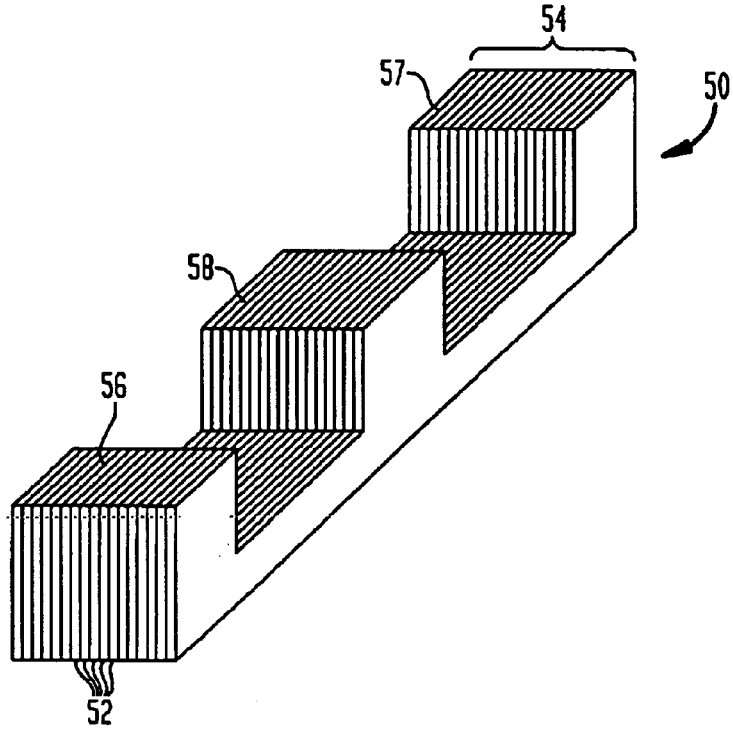
FIG. 2 is a perspective view of an armature or magnetic core of an electromagnet in accordance with the invention during an initial stage of assembly.
Figure 3:
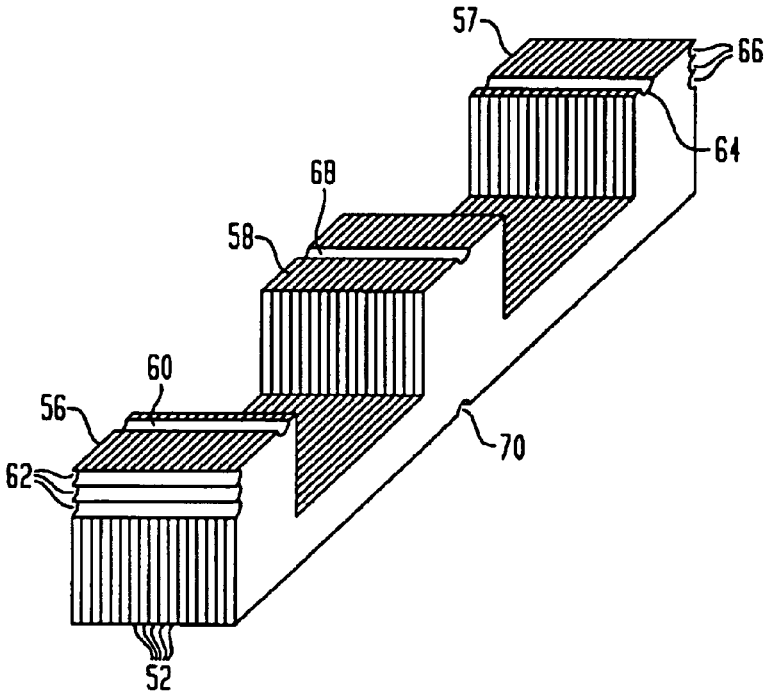
FIG. 3 is a view similar to FIG. 2 of the electromagnet after conductive areas are formed therein.
Figure 4:
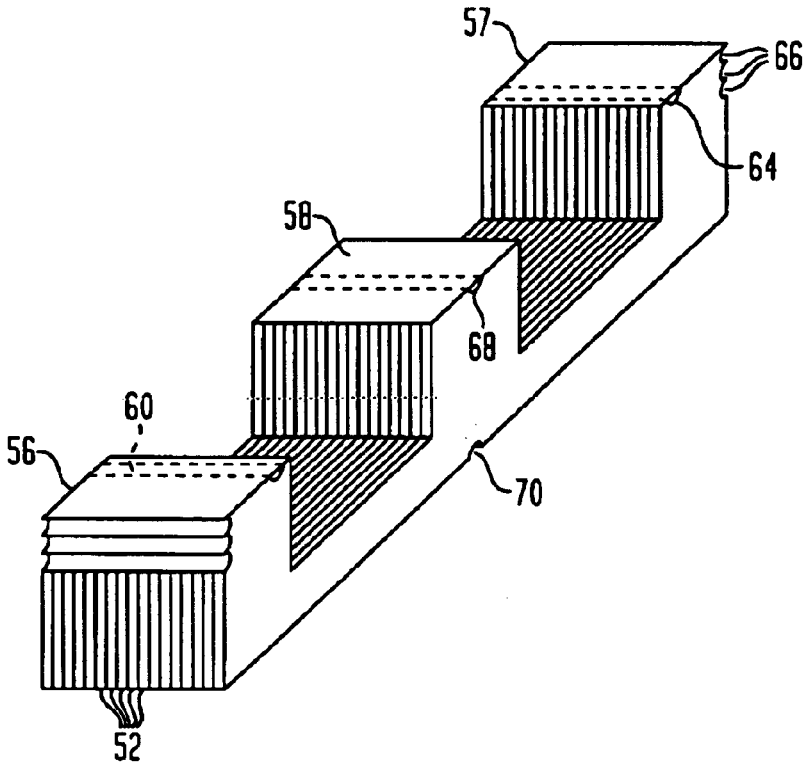
FIG. 4 is a view similar to FIGS. 2 and 3 of the electromagnet after grinding a mating surface.

FIGS. 2–4 illustrate an assembly sequence for the magnetic core 50 in accordance with the invention. Additionally, the method described can be used to produce the armature 48 with a shading coil, or both an armature and magnetic core for use in an electromagnet, as will be apparent to those skilled in the art.

Referring initially to FIG. 2, a plurality of "E-shaped" laminations 52 are stacked with each lamination 52 being aligned with the other laminations 52. The laminations 52 are temporarily held together by any known means, represented by a bracket 54, during initial stages of the assembly process. The laminations 52 are typically formed of a material such as silicon steel having approximately 6% silicon. However, the laminations 52 could be cold rolled steel or most other types of steel, except annealed stainless steel. The use of laminations is intended to prevent electrical currents from being conducted between laminations. The assembled laminations 52 define interface first and second opposite end mating surfaces 56 and 57 and a center mating surface 58 to be associated with corresponding mating surfaces of an associated armature, or magnetic core, as the case may be, as with the contactor 18 of FIG. 1.

Figure 5:
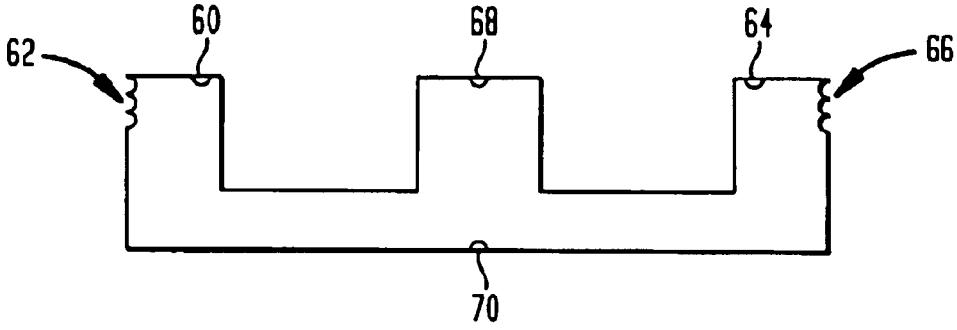
FIG. 5 is a side elevation view of the electromagnet of FIG. 4.

Referring to FIGS. 3 and 5, the laminations 52 are integrally secured together by welding a plurality of weld lines across or transverse to the stack of laminations 52. Owing to conductivity of the lamination material and/or an alloy used for welding, the weld lines comprise conductive lines that define conductive paths between laminations 52. Particularly, a single conductive line 60 is provided on the first end mating surface 56. Three parallel conductive lines 62 are provided just below the first end mating surface 56. The use of three conductive weld lines 62 provides as much conductivity as possible between the laminations 52. However, there may be room for only a single conductive weld line 60 on the mating surface 56 itself. In accordance with the invention, the depth of the single conductive weld line 60 may be greater than the three conductive weld lines 62. As is apparent, the conductive weld lines 60 and 62 in combination with the outermost laminations 52 form a continuous conductive path. This conductive path provides the function of a shading coil. Additionally, the weld lines 60 and 62 provide structural connections between the laminations 52.

Similarly, a single conductive weld line 64 is provided on the second end mating surface 57, while three conductive weld lines 66 are provided below the second end mating surface 57. The conductive lines 64 and 66 along with the outermost laminations 52 again form a shading coil. In accordance with the invention, the conductive weld lines 60, 62, 64 and 66 may comprise the sole means for securing the laminations 52 together. Additionally, a structural weld line 68 can be provided transversely in the central mating surface 58, with a similar structural weld line 70 opposite thereto.

Referring to FIG. 4, as a final manufacturing step, the mating surfaces 56, 57 and 58 may be subjected to a grinding operation to provide relatively smooth surfaces for a minimal magnetic air gap. In so doing, the single conductive weld lines 60, 64 and 68 may not be readily visible, but are still present as represented by the dashed lines.

As described above, conductive weld lines are used to define shading coils and to provide structural connections. Alternatively, conductive lines may be provided by conventional brazing techniques rather than welding. Moreover, conductive alloys may be added to the weld or braze lines to improve the conductivity of the shading coil. Copper would be a suitable alloy. As described, a shading coil is formed from either the base material of the laminations or an alternative welding material that is holding the laminations together. This avoids the addition of parts to the magnetic core or armature in order to hold it together and provide a shading coil. More particularly, the described solution replaces the separate pieces with conductive areas that are formed by weld or braze operations. These conductive areas may be structurally superior to rivet connections and also less expensive.

It can therefore be appreciated that a new and novel system and method for forming a shading coil within an electromagnet has been described. It will be appreciated by those skilled in the art that, given the teaching herein, numerous alternatives and equivalent will be seen to exist which incorporate the disclosed invention. As a result, the invention is not to be limited by the foregoing exemplary embodiments, but only by the following claims.

We claim:

1. An electromagnetically actuable device having a magnetic core proximate an armature and a coil selectively energized to draw the armature to the magnetic core, comprising:

the armature and magnetic core being of laminated magnetic steel and having mating surfaces and at least one of the armature and magnetic core including means for integrally securing laminations together to define a conductive path proximate the mating surface to provide a shading coil, wherein the securing means comprises the sole means for securing the laminations together.

2. The electromagnetically actuable device of claim 1 wherein the securing means comprises weld connections between adjacent laminations of the at least one of the armature and magnetic core.

3. The electromagnetically actuable device of claim 1 wherein the securing means comprises braze connections between adjacent laminations of the at least one of the armature and magnetic core.

4. The electromagnetically actuable device of claim 3 wherein the braze connections use a conductive alloy.

5. The elctromagnetically actuable device of claim 3 wherein the braze connections use copper.

6. The electromagnetically actuable device of claim 1 wherein a single conductive line is provided on the mating surface transverse to the laminations and a plurality of conductive lines are provided below the mating surface transverse to the laminations.

7. The electromagnetically actuable device of claim 6 wherein the single conductive line is of a greater depth than the plurality of conductive lines.

8. An electromagnetically actuable device having a magnetic core proximate an armature and a coil selectively energized to draw the armature to the magnetic core, comprising:

the armature and magnetic core including laminations of magnetic steel and having mating surfaces and at least one of the armature and magnetic core including conductive areas formed integrally with the laminations to define a conductive path proximate the mating surface to provide a shading coil, wherein the conductive areas are defined by securing means comprising the sole means for securing the laminations together.

9. The electromagnetically actuable device of claim 8 wherein the at least one of the armature and magnetic core comprises weld connections between adjacent laminations to define the conductive path.

10. The electromagnetically actuable device of claim 8 wherein the at least one of the armature and magnetic core comprises braze connections between adjacent laminations to define the conductive path.

11. The electromagnetically actuable device of claim 10 wherein the braze connections use a conductive alloy.

12. The electromagnetically actuable device of claim 10 wherein the braze connections use copper.

13. The electromagnetically actuable device of claim 8 wherein a single conductive line is provided on the mating surface transverse to the laminations and a plurality of conductive lines are provided below the mating surface transverse to the laminations to define the conductive areas.

14. The electromagnetically actuable device of claim 13 wherein the single conductive line is of a greater depth than the plurality of conductive lines.

* * * * *